US009079435B2

(12) United States Patent
Tsuchiya et al.

(10) Patent No.: US 9,079,435 B2
(45) Date of Patent: Jul. 14, 2015

(54) PRINTER APPARATUS

(71) Applicant: FUJITSU COMPONENT LIMITED, Tokyo (JP)

(72) Inventors: Masahiro Tsuchiya, Tokyo (JP); Yukihiro Mori, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 124 days.

(21) Appl. No.: 13/780,004

(22) Filed: Feb. 28, 2013

(65) Prior Publication Data

US 2013/0272768 A1 Oct. 17, 2013

(30) Foreign Application Priority Data

Apr. 13, 2012 (JP) ..... 2012-092436

(51) Int. Cl.

*B41J 11/70* (2006.01)
*B41J 11/66* (2006.01)
*B41J 15/04* (2006.01)

(52) U.S. Cl.

CPC *B41J 11/66* (2013.01); *B41J 11/70* (2013.01); *B41J 15/042* (2013.01)

(58) Field of Classification Search

CPC ..... B41J 29/13; B41J 11/70; B41J 11/66; B41J 15/042
USPC ..... 400/621
See application file for complete search history.

(56) References Cited

U.S. PATENT DOCUMENTS

| | | | | |
|---|---|---|---|---|
| 6,034,708 | A * | 3/2000 | Adams et al. | 347/217 |
| 7,510,343 | B1 * | 3/2009 | Arrington et al. | 400/621 |
| 2003/0007823 | A1 | 1/2003 | Tsuchiya et al. | |
| 2007/0104527 | A1 | 5/2007 | Watanabe et al. | |
| 2008/0003040 | A1 * | 1/2008 | Sekino et al. | 400/188 |
| 2008/0068437 | A1 * | 3/2008 | Hirai | 347/220 |
| 2011/0188917 | A1 * | 8/2011 | Naito | 400/663 |

FOREIGN PATENT DOCUMENTS

| | | |
|---|---|---|
| JP | 2003-019845 | 1/2003 |
| JP | 2007-130842 | 5/2007 |

* cited by examiner

*Primary Examiner* — Nguyen Ha
(74) *Attorney, Agent, or Firm* — IPUSA, PLLC

(57) ABSTRACT

A printer apparatus includes a print unit that prints an object on recording paper, a platen roller that conveys the recording paper, a cutter that cuts the recording paper, a mainframe that accommodates the print unit and the cutter, a cover that is attached to the mainframe and is configured to open and close with respect to the mainframe, the cover having the platen roller arranged thereon. The cover includes a lock member having a lock pin, and when the cover is closed, the lock pin of the lock member is moved towards the platen roller and is inserted into a lock pin fixing part that is arranged at the mainframe.

5 Claims, 16 Drawing Sheets

PRINTER APPARATUS

CROSS-REFERENCE TO RELATED APPLICATIONS

This patent application is based upon and claims the benefit of priority of Japanese Patent Application No. 2012-092436 filed on Apr. 13, 2012 the entire contents of which are incorporated herein by reference.

BACKGROUND OF THE INVENTION

1. Field of the Invention

The present invention relates to a printer apparatus.

2. Description of the Related Art

Printers for issuing receipts are widely used in various applications including cash registers, Automated Teller Machines (ATM), and Cash Dispensers (CD), for example. Such printers are configured to issue a receipt by conveying thermal recording paper that is wound into a roll, printing objects such as characters on the recording paper using a print head, and conveying the recording paper up to a predetermined length so that the recording paper may be cut at the predetermined length by a cutter (See, e.g., Japanese Laid-Open Patent Publication No. 2003-19845, and Japanese Laid-Open Patent Publication No. 2007-130842).

It is noted that some printers include a stationary blade and a movable blade as the cutter so that the recording paper may be cut by moving the movable blade. Other printers only have a stationary blade so that the recording paper is cut manually by pulling the recording paper.

In the case where the cutter only includes a stationary blade so that the recording paper is cut manually, the cutter may be a simple member made of the stationary blade and no mechanical parts or motor for moving a movable blade is necessary. Thus, such a cutter may be suitable for a small printer apparatus.

In the following, an exemplary printer apparatus that is configured to have recording paper pulled and cut manually with a stationary blade is described with reference to FIGS. 1A-1C. The printer apparatus includes recording paper 910 that is wound into a roll, a thermal head 920 and a stationary blade 930 that are attached to a mainframe 911, and a platen roller 921 that is attached to a cover 912 that may be opened and closed to enable loading or removal of the roll of recording paper 910. The thermal head 920 prints objects such as characters on the recording paper 910 when it passes between the thermal head 920 and the platen roller 921, and the platen roller 921 discharges the recording paper 910, which has objects printed thereon, by rotating in a paper discharging direction. The recording paper 910 having the objects printed thereon that is discharged by the platen roller 921 may then be cut by the stationary blade 930 when the recording paper 910 is pulled in the direction of arrow A shown in FIG. 1A When using the illustrated printer apparatus, however, the recording paper 910 may be pulled in the wrong direction such as the direction of arrow B shown in FIG. 1B instead of the direction of arrow A. In such a case, as is shown in FIG. 1C, the force pulling the recording paper 910 may be applied to the platen roller 921 to thereby cause the cover 912 to open. When the cover 912 is opened in this manner, the recording paper 910 loaded in the printer apparatus may fall out.

SUMMARY

According to one embodiment of the present invention, a printer apparatus is provided that includes a print unit that prints an object on recording paper, a platen roller that conveys the recording paper having the object printed thereon by the print unit, a cutter that cuts the recording paper having the object printed thereon by the print unit, a mainframe that accommodates the print unit and the cutter, a cover that is attached to the mainframe and is configured to open and close with respect to the mainframe, the cover having the platen roller arranged thereon. The cover includes a lock member having a lock pin, and when the cover is closed, the lock pin of the lock member is moved towards the platen roller and is inserted into a lock pin fixing part that is arranged at the mainframe.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

Figure 1A:
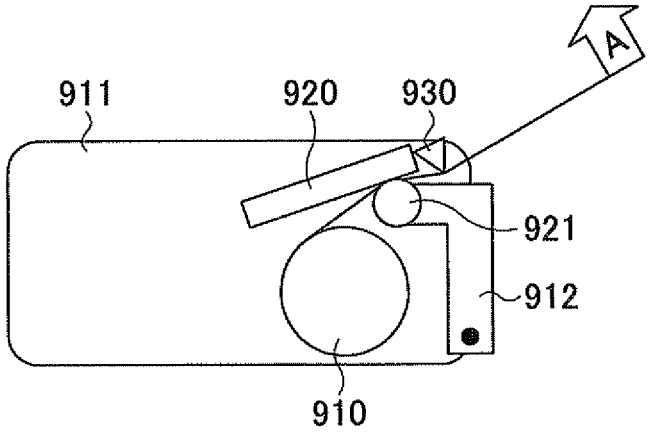
FIGS. 1A-1C are diagrams illustrating an exemplary printer apparatus.
Figure 1B:
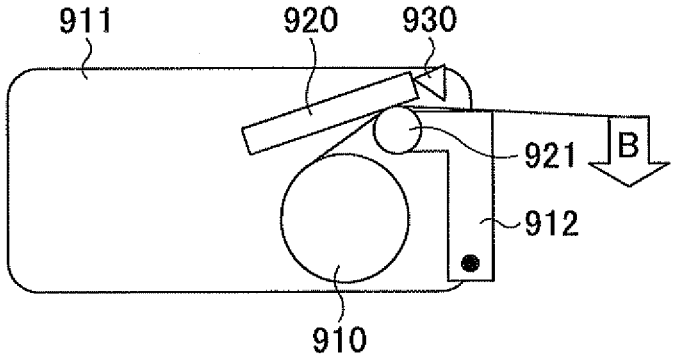
Figure 1C:
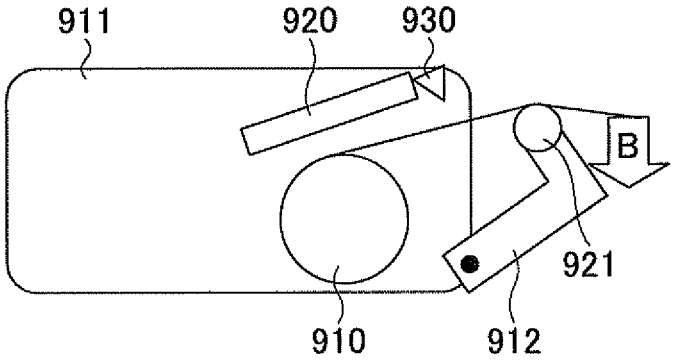

In the following, embodiments of the present invention are described with reference to the accompanying drawings. The same or corresponding features shown in more than one of the drawings may be given the same reference numerals and their descriptions may be omitted.

(Configuration of Printer Apparatus)

A configuration of a printer apparatus according to an embodiment of the present invention is described with reference to FIGS. 2-11.

Figure 2:
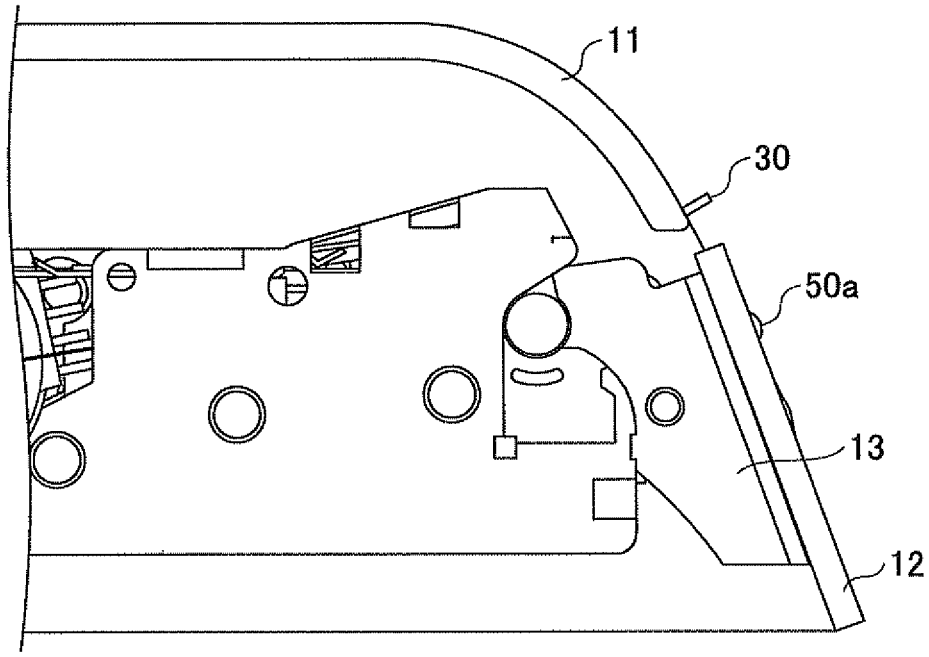
FIG. 2 is a diagram showing a configuration of a printer apparatus according to an embodiment of the present invention when a cover is closed.
Figure 3:
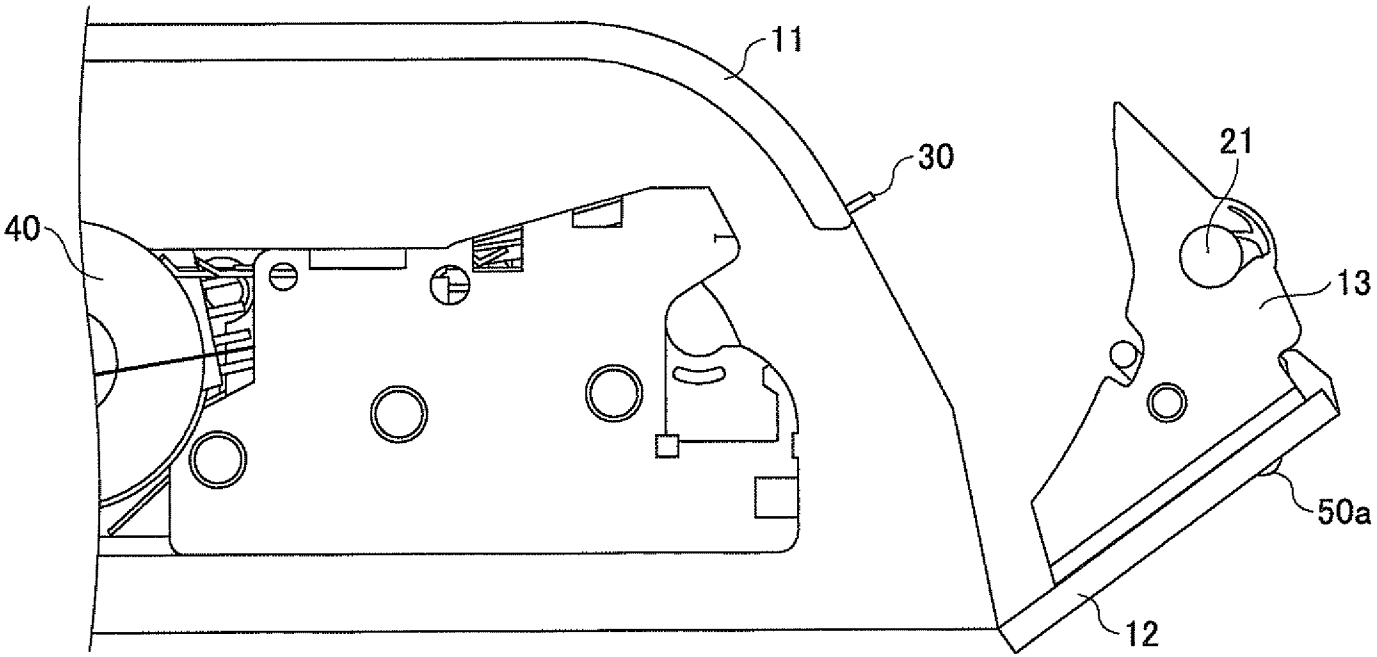
FIG. 3 is a diagram showing the configuration of the printer apparatus when the cover is open.

Referring to FIGS. 2 and 3, the printer apparatus according to the present embodiment includes a mainframe 11 and a cover 12 attached to the mainframe 11 that may be opened and closed. The printer apparatus may print objects such as characters on recording paper 10 when the cover 12 is closed as is shown in FIG. 2, and the printer apparatus may have the recording paper 10 that is wound into a roll loaded therein when the cover 12 is open as is shown in FIG. 3.

The printer apparatus according to the present embodiment also includes a thermal head 20 (an example of a print unit) that prints objects such as characters on the recording paper 10, and a cutter 30 that cuts the recording paper 10, having the objects printed thereon by the thermal head 20, at a predetermined length. The recording paper 10 may be thermal paper, for example, but may be some other type of medium as well. Objects such as characters may be printed on the recording paper 10 by the thermal head 20 while the recording paper 10 is held between the thermal head 20 and a platen roller 21.

Figure 4:
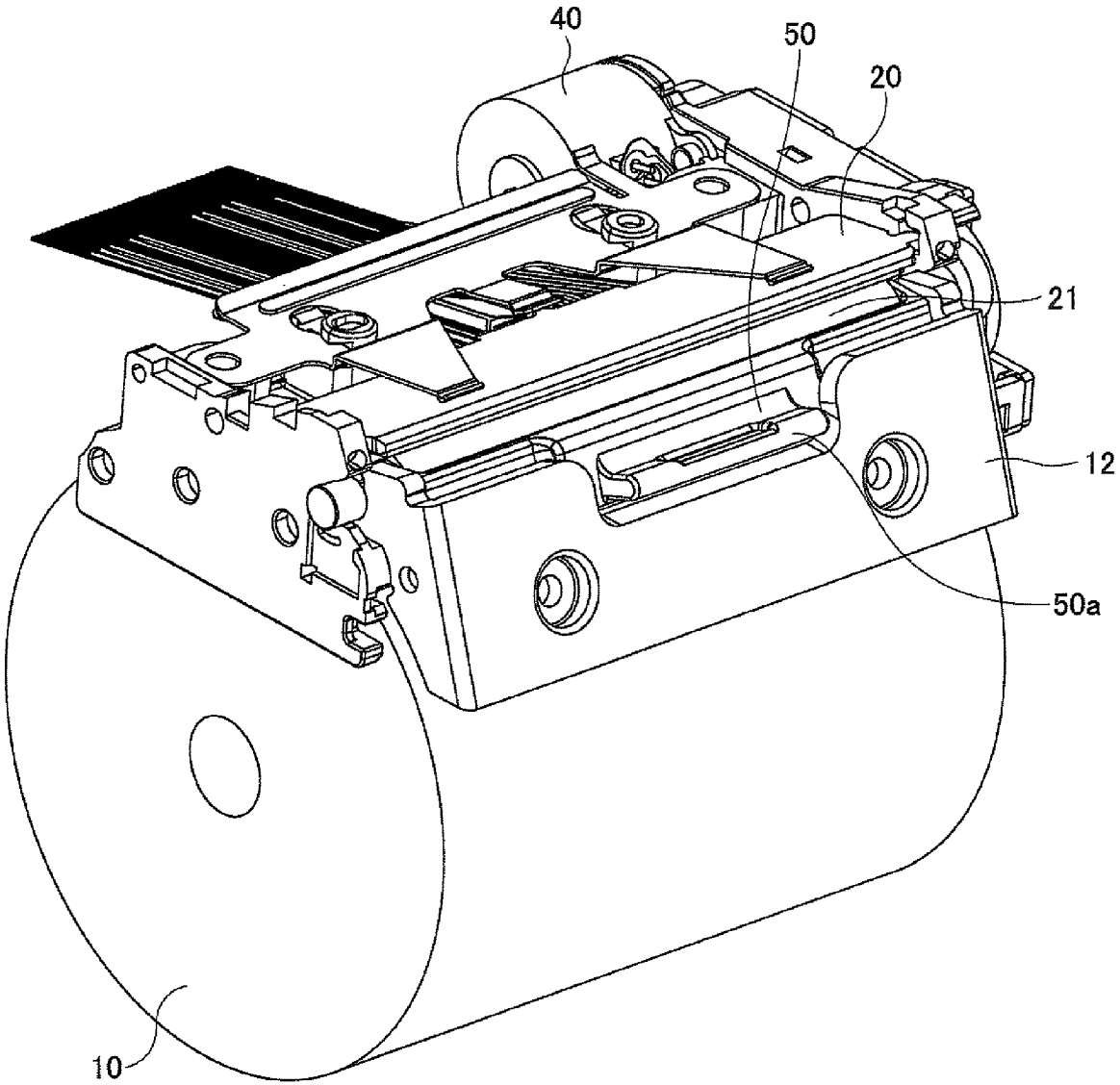
FIG. 4 is a perspective view of an internal portion of the printer apparatus when the cover is locked.
Figure 5:
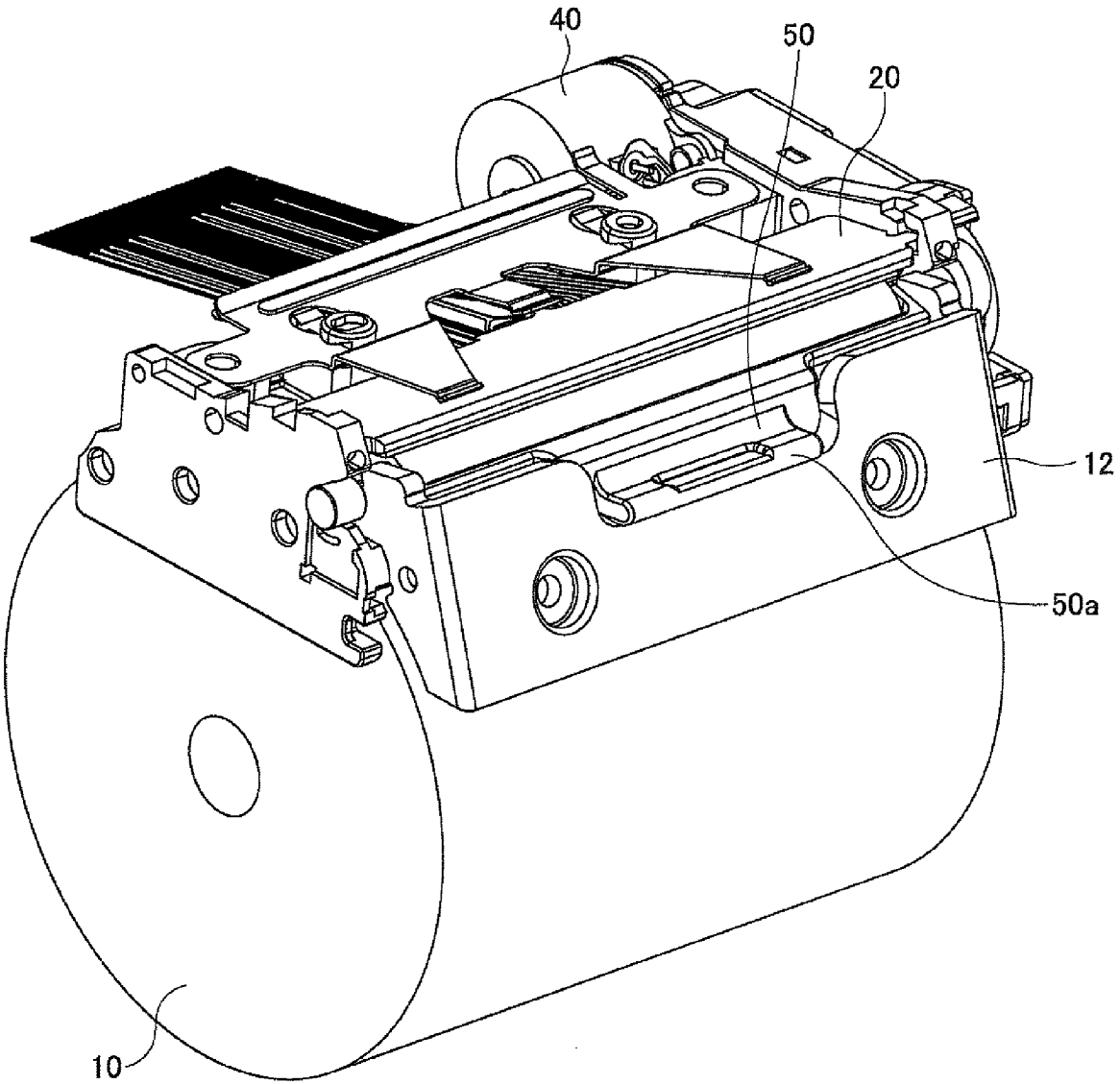
FIG. 5 is a perspective view of the internal portion of the printer apparatus when the cover is unlocked.

FIGS. 4 and 5 are perspective views of an internal portion of the printer apparatus according to the present embodiment. FIG. 4 shows the printer apparatus when the cover 12 is locked and FIG. 5 shows the printer apparatus when the cover 12 is unlocked.

Figure 6:
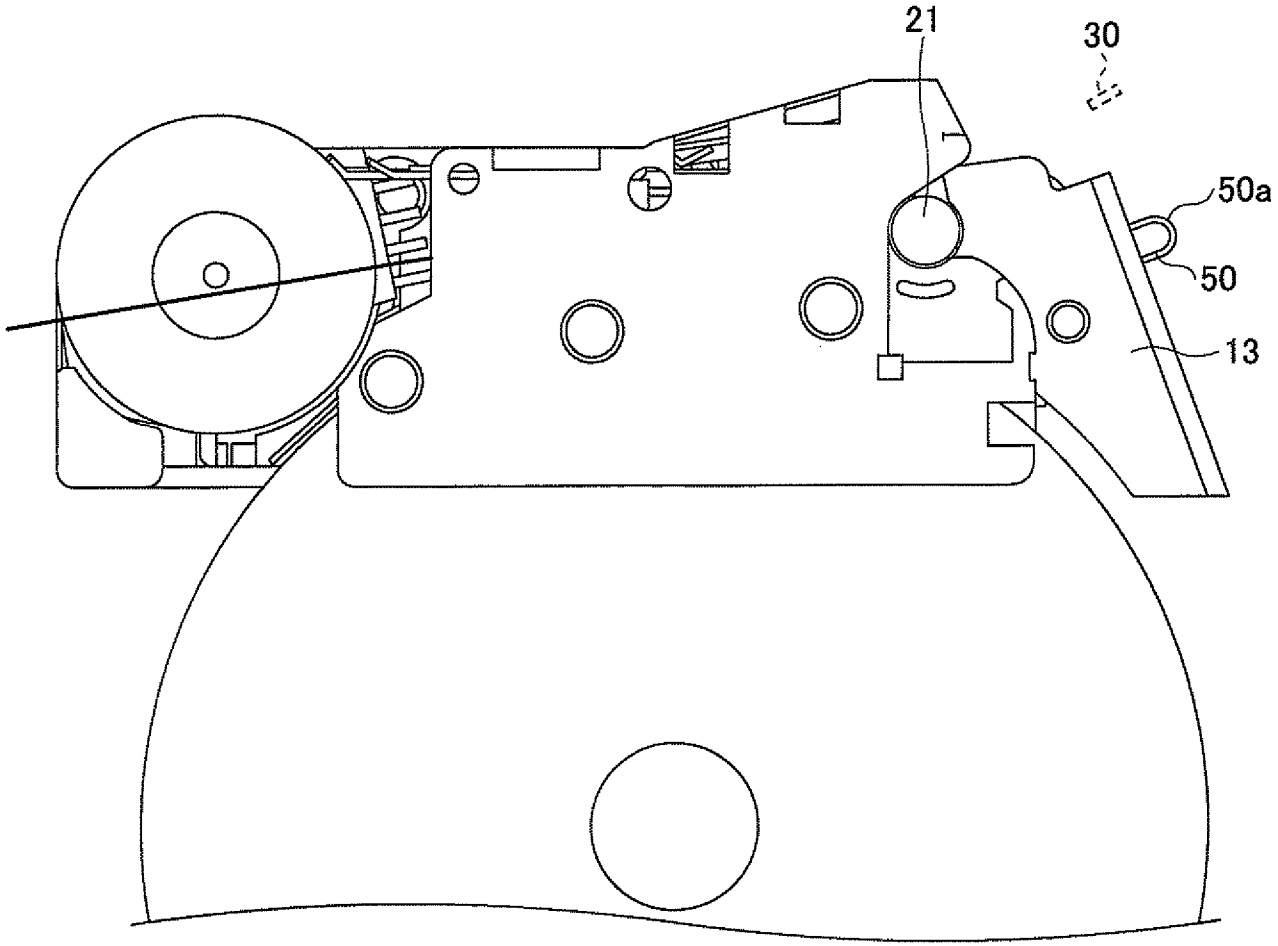
FIG. 6 is a side view of an internal portion of the printer apparatus when the cover is locked.
Figure 7:
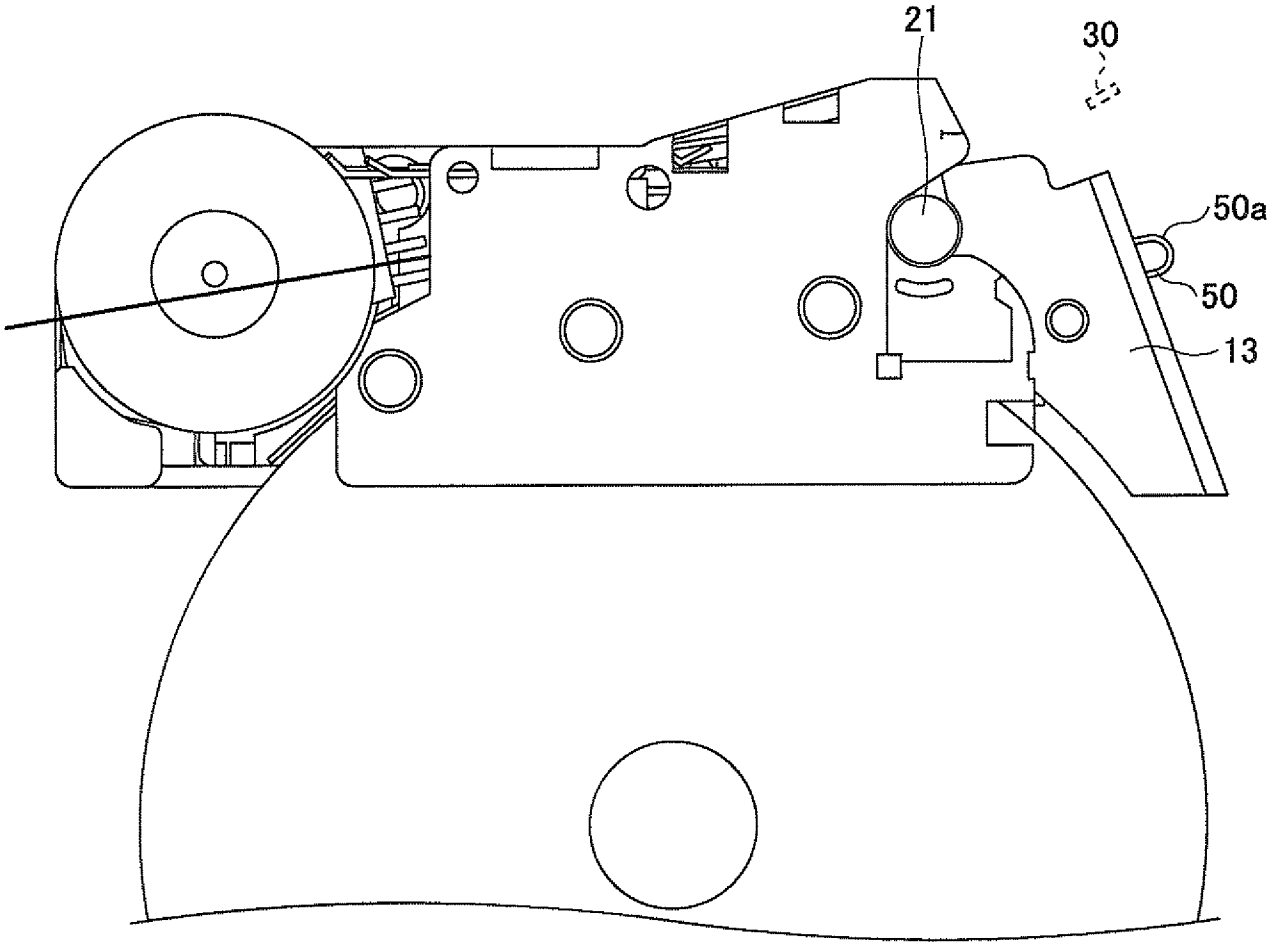
FIG. 7 is a side view of the internal portion of the printer apparatus when the cover is unlocked.

FIGS. 6 and 7 are side views of an internal portion of the printer apparatus according to the present embodiment. FIG. 6 shows the printer apparatus when the cover 12 is locked and FIG. 7 shows the printer apparatus when the cover 12 is unlocked. It is noted that in FIGS. 6 and 7, the position of the cutter 30 is indicated by broken lines.

Figure 8:
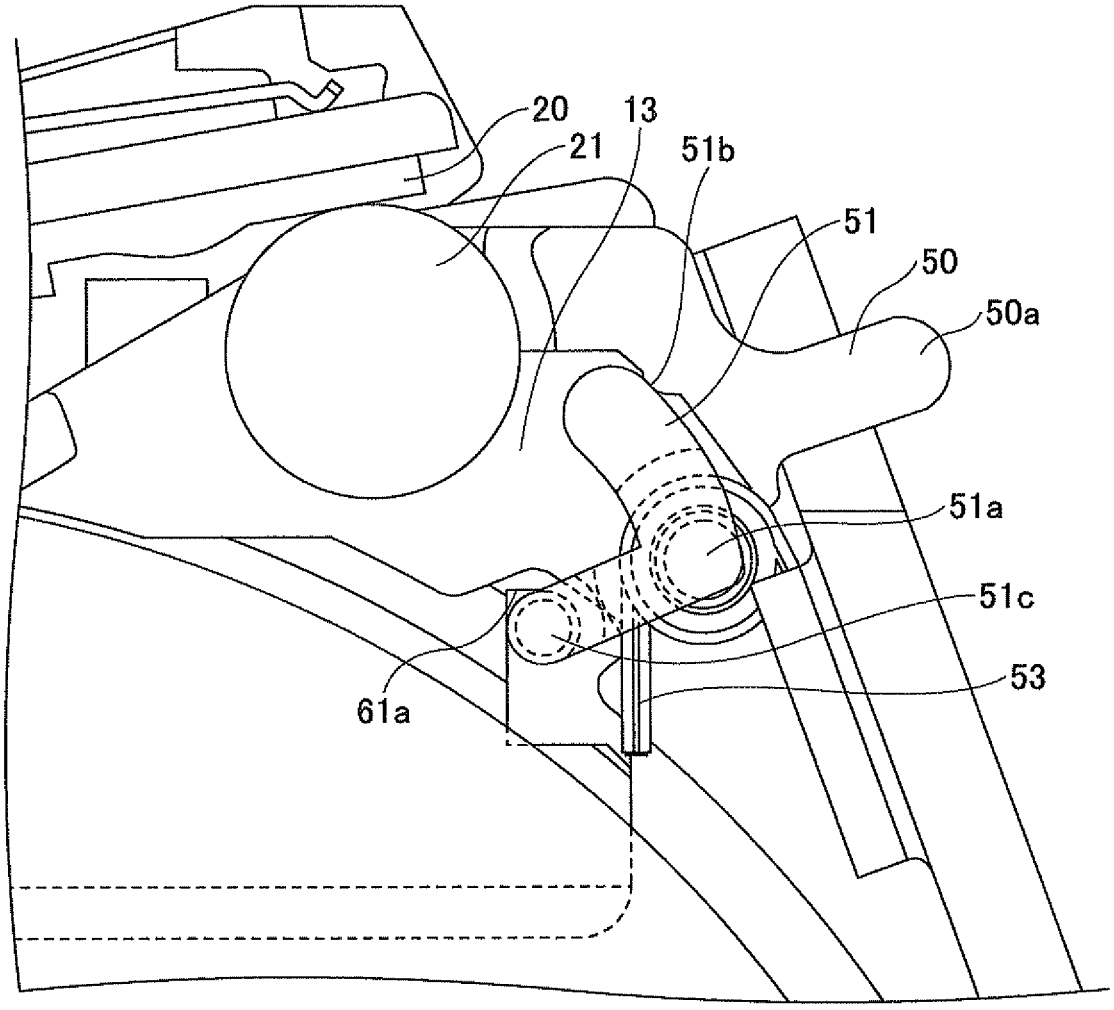
FIG. 8 is a diagram showing an internal configuration of the printer apparatus when the cover is locked.
Figure 9:
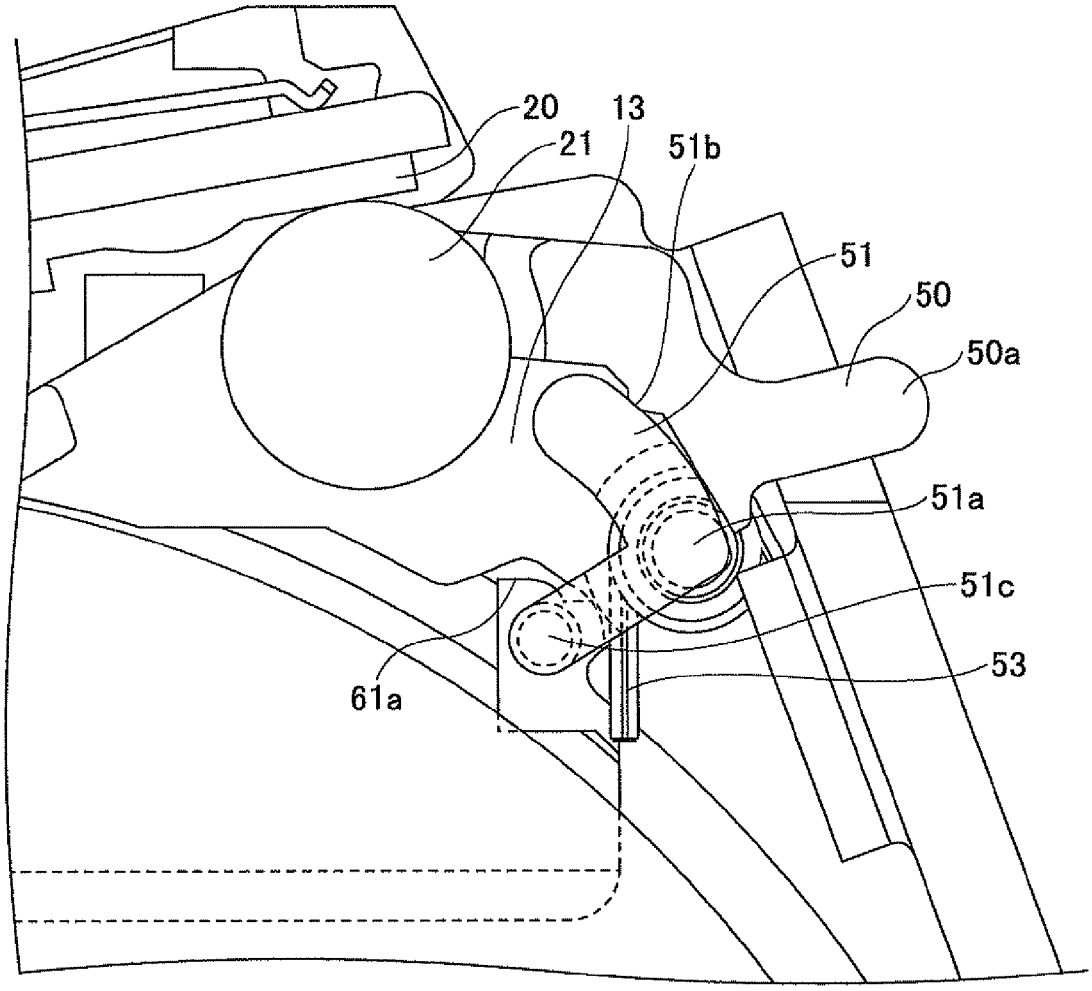
FIG. 9 is a diagram showing the internal configuration of the printer apparatus when the cover 12 is unlocked.
Figure 10:
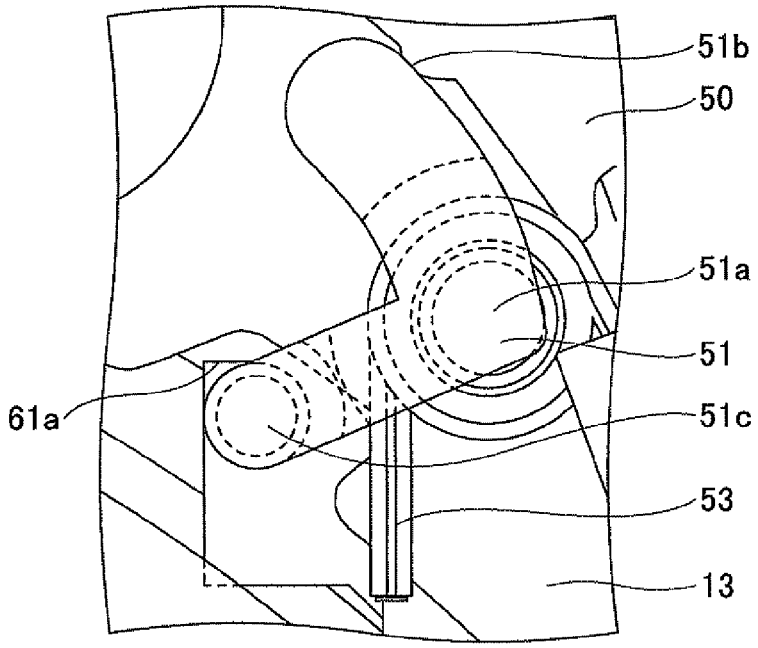
FIG. 10 is an enlarged view of a relevant portion of FIG. 8.
Figure 11:
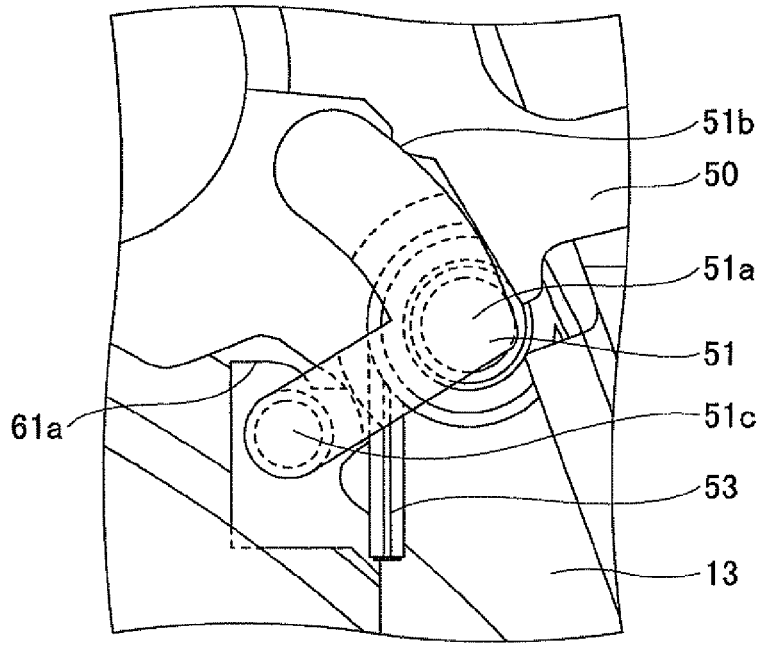
FIG. 11 is an enlarged view of a relevant portion of FIG. 9.

FIGS. 8 and 9 are cross-sectional views of an internal portion of the printer apparatus according to the present embodiment. FIG. 8 shows an internal configuration of the printer apparatus when the cover 12 is locked and FIG. 9 shows the internal configuration of the printer apparatus when the cover 12 is unlocked. FIG. 10 is an enlarged view of a relevant portion of FIG. 8. FIG. 11 is an enlarged view of a relevant portion of FIG. 9.

Referring to FIGS. 4-11, in the printer apparatus according to the present embodiment, the cover 12 has the platen roller 21, a platen roller holding member 13, a lock lever 50, and a lock member 51 arranged thereon. The platen roller 21 is held by the platen roller holding member 13. The lock lever 50 has an operating part (convex part) 50*a* that is arranged to protrude out towards the outer side of the cover 12.

Figure 12:
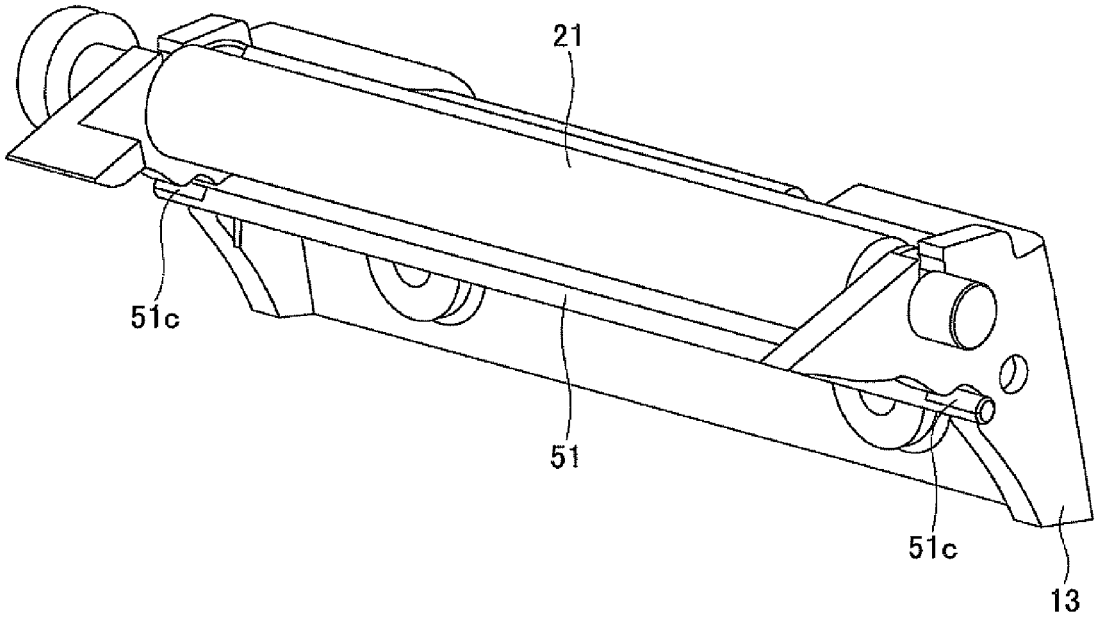
FIG. 12 is a perspective view of a lock member arranged at the cover as seen from the inner side.
Figure 13:
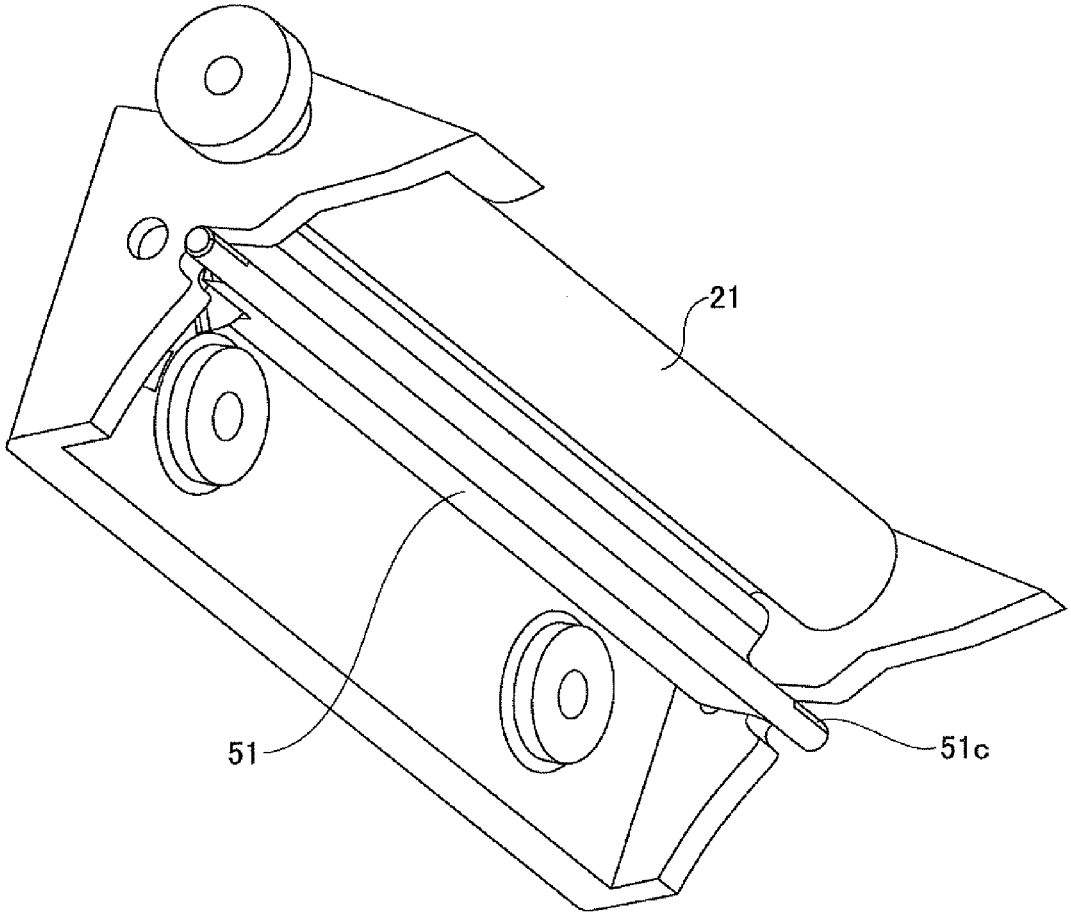
FIG. 13 is a perspective view of the lock member arranged at the cover as seen from the lower side.
Figure 14:
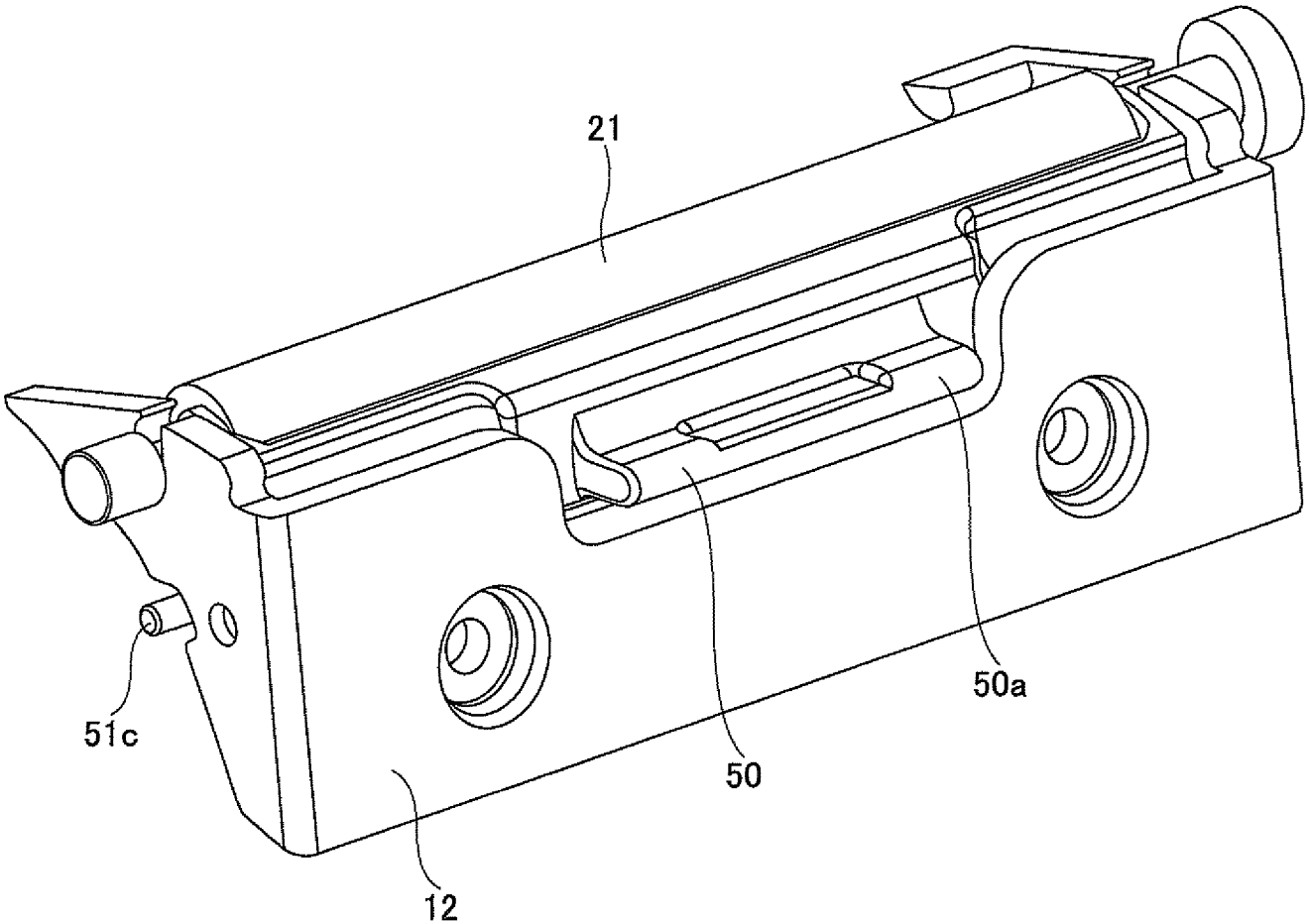
FIG. 14 is a perspective view of the a lock lever and the lock member arranged at the cover as seen from the outer side.
Figure 15:
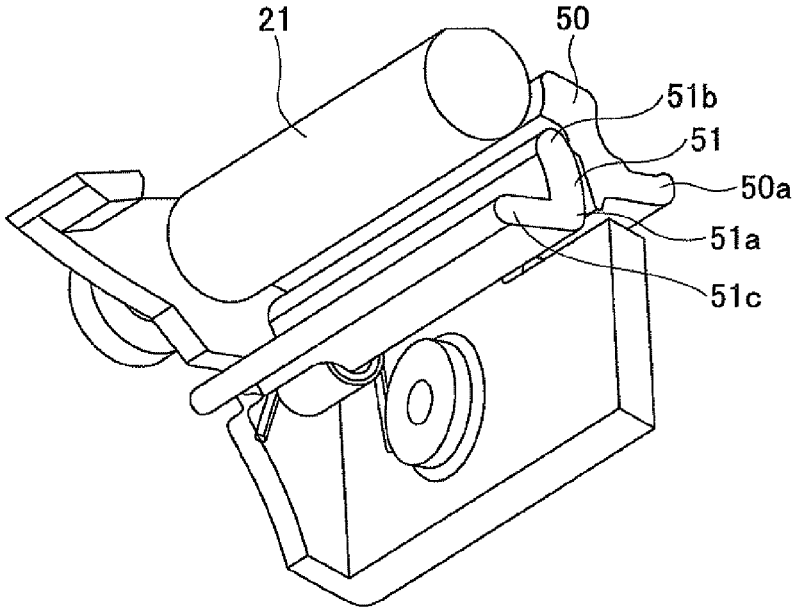
FIG. 15 is a cross-sectional perspective view of the lock lever and the lock member arranged at the cover.

Referring to FIGS. 8-15, the lock member 51 is arranged into an L-shape in cross-section and extends along the length of the platen roller 21. The portion of the lock member 51 that is bent to form the L-shape corresponds to a lock member rotational axis 51*a*, and the lock member 51 is arranged at the cover 12 in a manner such that it may rotate around the lock member rotational axis 51*a*. The lock member 51 also has a lock member contact part 51*b* that comes into contact with the lock lever 50 arranged near one end of its L-shaped structure and a lock pin 51*c* arranged near the other end of its L-shaped structure. FIG. 12 is a perspective view of the lock member 51 arranged at the cover 12 as seen from the inner side; FIG. 13 is a perspective view of the lock member 51 arranged at the cover 12 as seen from the lower side; FIG. 14 is a perspective view of the lock lever 50 and the lock member 51 arranged at the cover 12 as seen from the outer side; and FIG. 15 is a cross-sectional perspective view of the lock lever 50 and the lock member 50.

The lock member 51 arranged at the cover 12 in the above manner rotates around the lock lever rotational axis 51*a* when the operating part 50*a* of the lock lever 50 is pushed downward to shift the position of the lock pin 51*c*.

Figure 16:
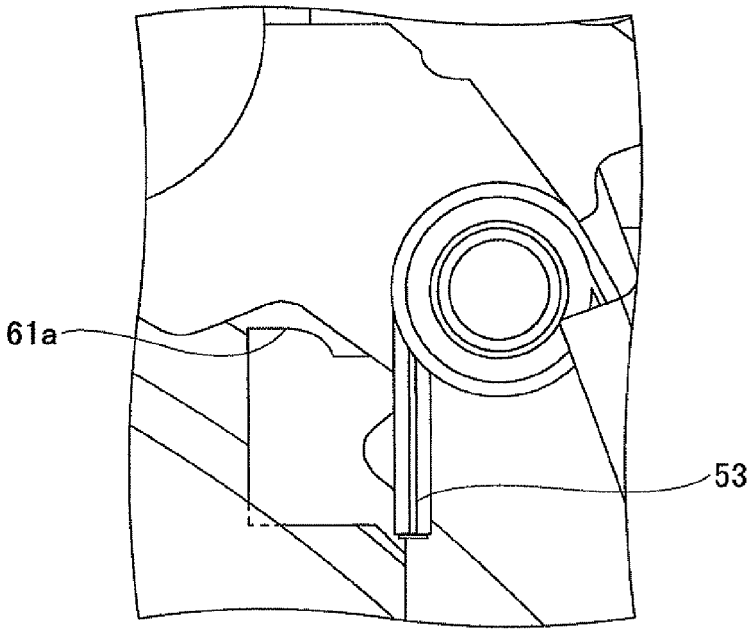
FIG. 16 is a diagram showing the position of a lock pin fixing part arranged at a mainframe of the printer apparatus.
Figure 17:
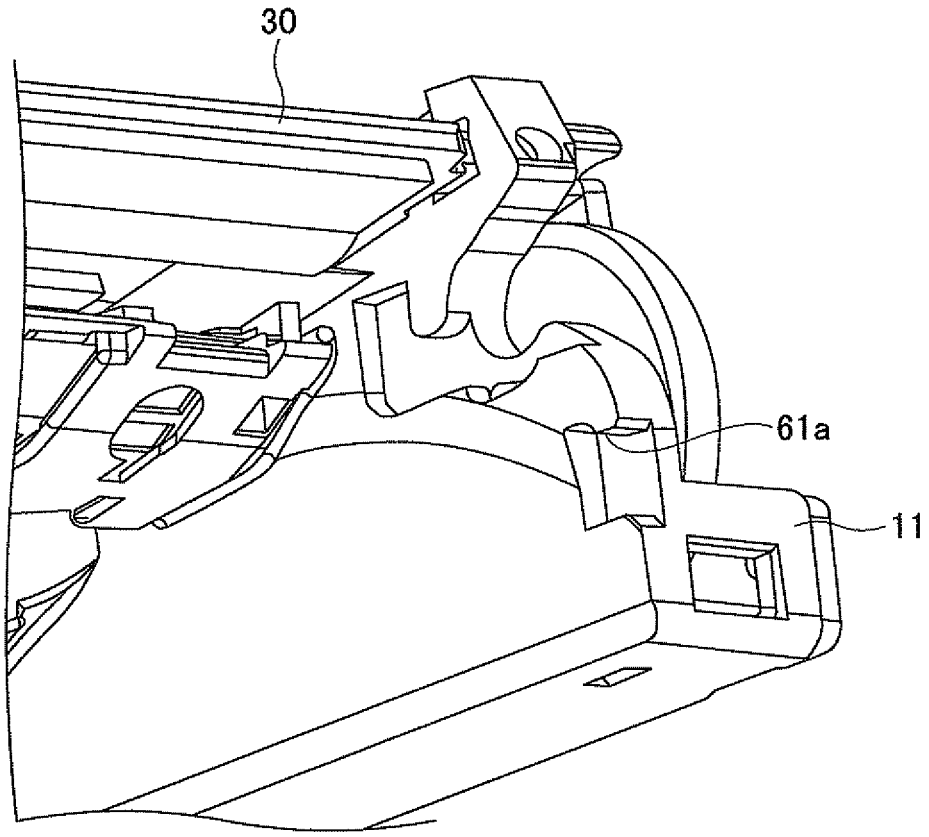
FIG. 17 is a perspective view of the lock pin fixing part.
Figure 18:
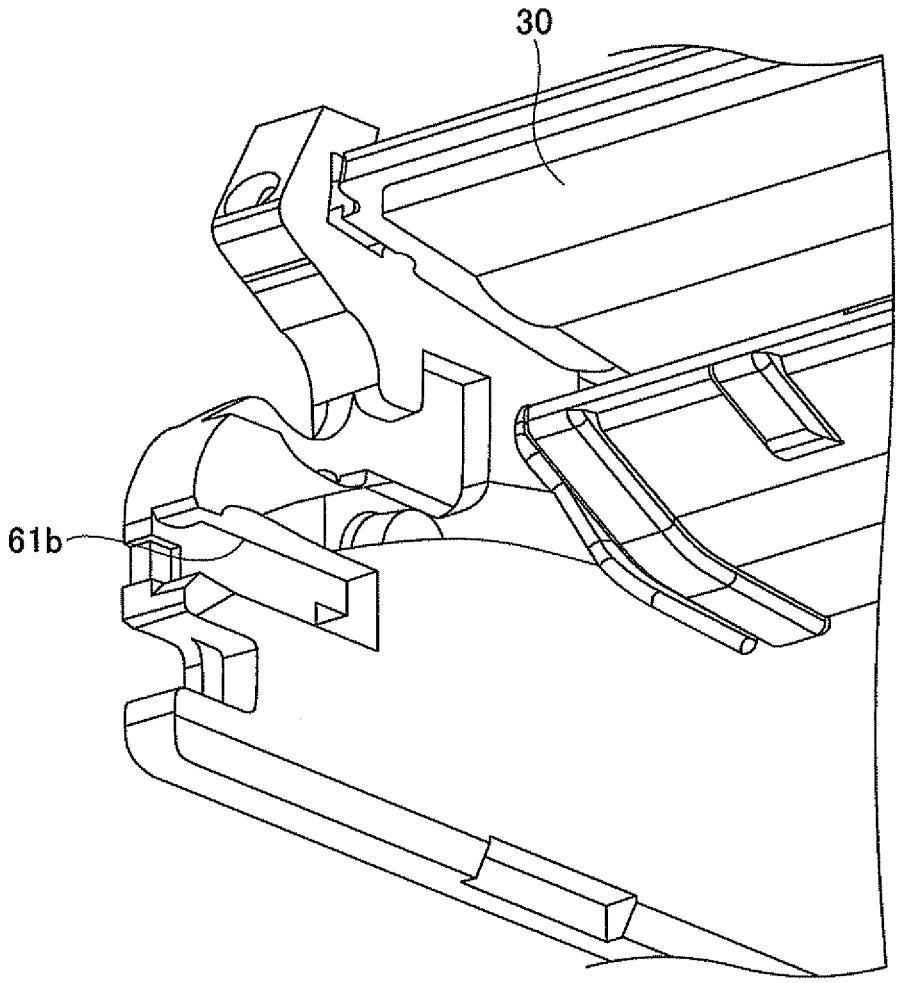
FIG. 18 is a perspective view of the lock pin fixing part arranged at the other side of the mainframe.

Also, as is shown in FIGS. 4 and 5, in the printer apparatus according to the present embodiment, the thermal head 20, the cutter 30, and a motor 40 for rotating the platen roller 21 are arranged at the mainframe 11. Further, as is shown in FIGS. 16-18, the mainframe 11 has lock pin fixing parts 61*a* and 61*b* arranged close to an entrance for the recording paper 10. The lock pin fixing parts 61*a* and 61*b* are arranged at the inner side of the mainframe 11 and are configured to fix the lock member 51 when the lock pin 51*c* of the lock member 51 is inserted into the lock pin fixing parts 61*a* and 61*b*. FIG. 16 shows the position of the lock pin fixing part 61*a*; FIG. 17 is a perspective view of the lock pin fixing part 61*a*; and FIG. 18 is a perspective view of the lock pin fixing part 61*b* arranged at the other side of the mainframe 11.

(Locking the Cover)

In the printer according to the present embodiment, when printing operations are performed on the recording paper 10 by the thermal head 20, the cover 12 is closed as is shown in FIGS. 2, 4, and 6. In this case, the lock pin 51*c* is moved towards the platen roller 21 and is inserted into the lock pin fixing parts 61*a* and 61*b* as is shown in FIGS. 8 and 10. By inserting the lock pin 51*c* into the lock pin fixing parts 61*a* and 61*b*, the closed state of the cover 12 may be fixed and maintained. In this way, the cover 12 may be prevented from opening even when the recording paper 10 that has been discharged is pulled in an opposite direction from the cutting direction of the cutter 30, or when the printer apparatus is accidentally dropped, for example.

(Unlocking the Cover)

In the following, a manner of loading the recording paper 10 into the printer apparatus of the present embodiment is described. To load the recording paper 10 into the printer apparatus of the present embodiment, the cover 12 is opened from the mainframe 11 as is shown in FIGS. 3, 5, and 7 so that the roll of recording paper 10 may be loaded inside the mainframe 11. To open the cover 12, a downward force is applied to the lock lever 50 arranged at the cover 12 so that the lock lever 50 may move downward. By moving the lock lever 50 downward in this manner, the lock member contact part 51*b* of the lock member 51 may be pushed by the convex part 50*a* arranged at the lock lever 50. In turn, the lock member 51 may be rotated around the lock lever rotational axis 51*a* so that the lock pin 51*c* moves in a direction away from the platen roller 21 to be disengaged from the lock pin fixing parts 61*a* and 61*b* as is shown in FIGS. 9 and 11. In this way, the cover 12 may be unlocked from the lock pin fixing parts 61*a* and 61*b* so that it may be freely opened and closed. By unlocking the cover 12 so that it may be freely opened and closed, the cover 12 may be opened and the roll of recording paper 10 may be loaded inside the mainframe 11.

Also, in the embodiment, a torsion spring 53 is arranged at the cover 12 so that when the lock lever 50 is pushed downward, a restoring force in the opposite direction with respect to the rotational direction of the lock member 51 is generated. In this way, once the lock lever 50 is released from the force pushing it downward, the restoring force of the torsion spring 53 may cause the lock member 51 to rotate around the lock member rotational axis 51*a* in the opposite direction to reposition the lock lever 50 to its original position.

(Recording Paper Detection Sensor)

Figure 19:
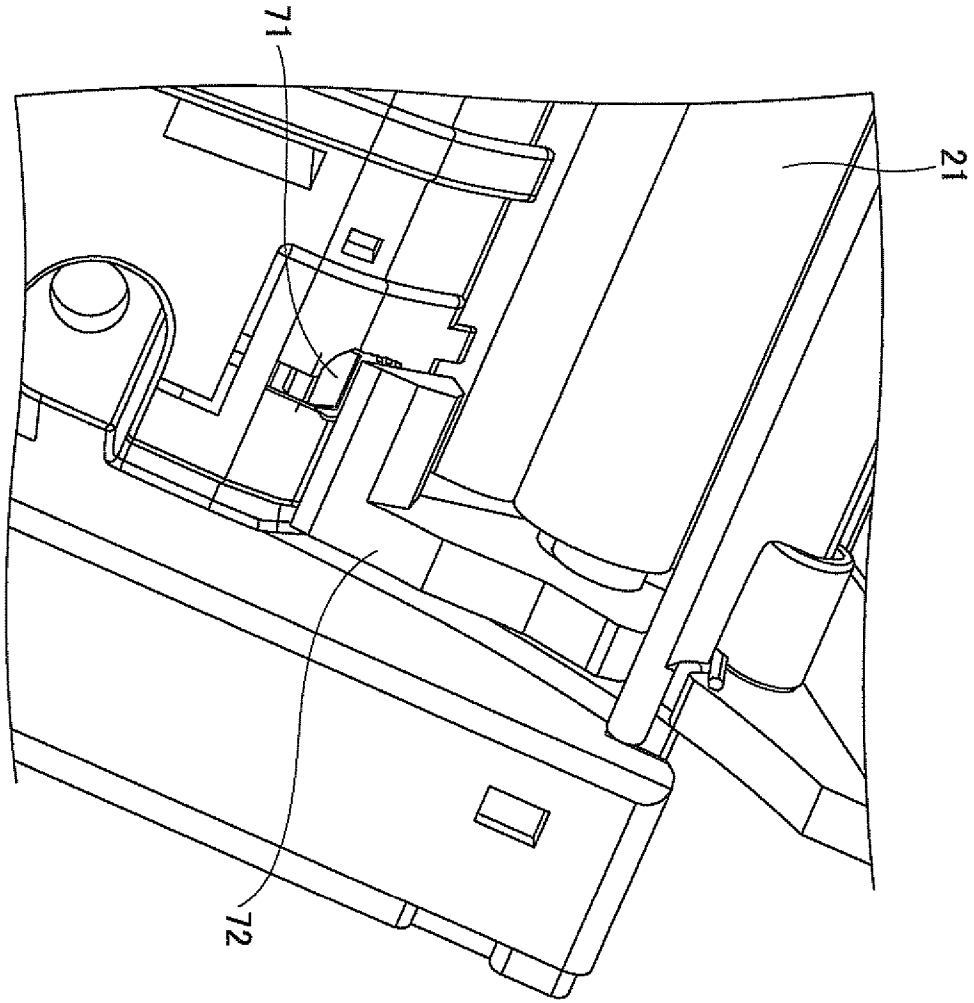
FIG. 19 is a diagram showing a recording paper detection sensor and a recording paper guide part of the printer apparatus.

As is shown in FIG. 19, the printer apparatus of the present embodiment may also have a recording paper detection sensor 71 for detecting the presence of the recording paper 10 arranged near the platen roller 21 and a recording paper guide part 72 for arranging the recording paper detection sensor 71 and the recording paper 10 to be in a predetermined positional relationship. In the present embodiment, the recording paper detection sensor 71 is a reflective optical sensor that irradiates light on the surface of the recording paper 10 and detects the light reflected by the recording paper 10. In the case where such a reflective optical sensor is used as the recording paper detection sensor 71, detection errors may occur when the recording paper 10 is not positioned within a predetermined distance range from the recording paper detection sensor 71. Thus, the recording paper guide part 72 is arranged so that the distance between the recording paper detection sensor 71 and the recording paper 10 may be within a predetermined range.

The present invention is not limited to the above embodiments. All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present invention have been described in detail, it should be understood that the various changes, substitutions, and alterations could be made hereto without departing from the spirit and scope of the invention.

What is claimed is:

1. A printer apparatus, comprising:

a print unit that prints an object on recording paper;

a cutter that cuts the recording paper;

a mainframe that accommodates the print unit and the cutter;

a cover that is rotatably attached to the mainframe and is configured to be opened and closed with respect to the mainframe;

a platen roller arranged at the cover, that conveys the recording paper;

a lock pin fixing part arranged at the mainframe;

a lock lever slidingly arranged on the cover; and a lock member arranged on the cover, wherein the lock member has an L-shape in cross section having two end portions, and rotatably provided on the cover around a lock member rotational axis, the lock member rotational axis is disposed at a corner of the L-shape, the lock member includes a lock member contact part arranged at one end portion of the L-shape protruding externally from the mainframe when the cover is opened, the lock member contact part maintains contact with the lock lever at the external side regardless of whether the cover is closed or opened, and a lock pin terminating at the other end portion of the L-shape, wherein the lock pin is inserted into the lock pin fixing part when the cover is closed and removed from the lock pin fixing part when the cover is opened by a sliding action of the lock lever.

2. The printer apparatus as claimed in claim 1, wherein when the lock lever is pushed, the lock member is rotated around the lock member rotational axis and the lock pin is disengaged from the lock pin fixing part.

3. The printer apparatus as claimed in claim 2, further comprising:

a spring provided at the cover, the spring applies a restoring force to the lock member in a direction opposite to a direction that the lock member rotates when the lock lever is pushed down.

4. The printer apparatus as claimed in claim 2, wherein when the lock lever is pushed, the lock member is rotated around the lock member rotational axis in a direction opposite to the direction that the cover opens.

5. The printer apparatus as claimed in claim 1, further comprising:

a recording paper detection sensor that is arranged near the platen roller and is configured to detect the recording paper; and a recording paper guide part that arranges for a distance between the recording paper detection sensor and the recording paper to be within a predetermined range.

* * * * *